US009364389B1

(12) United States Patent
Conrad

(10) Patent No.: US 9,364,389 B1
(45) Date of Patent: Jun. 14, 2016

(54) HYGIENIC WATER JET ASSEMBLY

(71) Applicant: Mansfield Plumbing Products, LLC, Perrysville, OH (US)

(72) Inventor: Paul Conrad, Ashland, OH (US)

(73) Assignee: MANSFIELD PLUMBING PRODUCTS, LLC, Perrysville, OH (US)

( * ) Notice: Subject to any disclaimer, the term of this patent is extended or adjusted under 35 U.S.C. 154(b) by 238 days.

(21) Appl. No.: 14/265,518

(22) Filed: Apr. 30, 2014

(51) Int. Cl.
*A61H 33/02* (2006.01)
*A61H 33/00* (2006.01)

(52) U.S. Cl.
CPC ..... *A61H 33/6021* (2013.01); *A61H 33/027* (2013.01)

(58) Field of Classification Search
CPC ..... A61H 33/027
USPC ..... 239/104, 106, 110, 428.5; 4/492, 507, 4/541.1–541.6; 601/157
See application file for complete search history.

(56) References Cited

U.S. PATENT DOCUMENTS 4,593,420 A * 6/1986 Tobias ..... A61H 33/027 239/428.5
4,662,568 A 5/1987 Bauer
4,671,463 A * 6/1987 Moreland ..... A61H 33/027 239/428.5
5,095,558 A 3/1992 Howard
5,862,543 A 1/1999 Reynoso et al.
6,691,336 B2 2/2004 Buck
7,070,129 B1 7/2006 Raghu et al.
2003/0208841 A1 * 11/2003 Marks ..... A61H 33/027 4/541.6
2004/0168249 A1 * 9/2004 Gerth ..... A61H 33/027 4/541.6
2007/0226893 A1 10/2007 Edris
2008/0097265 A1 4/2008 Colin

* cited by examiner

*Primary Examiner* — Kevin P Shaver
*Assistant Examiner* — Nicholas Ros
(74) *Attorney, Agent, or Firm* — Renner Kenner Greive Bobak Taylor & Weber

(57) ABSTRACT

A hygienic water jet assembly for a spa includes a body having a conical jet outlet that receives pressurized water and air from suitable sources. A control insert is disposed within the conical jet outlet and spaced therefrom by a gap, such that the control insert serves to combine the water and air together for delivery to a jet nozzle carried by the control insert. The control insert also includes a pair of conical surfaces that allows residual water within the control insert to drain by gravity out of the control insert through apertures disposed therethrough. The water draining out of the control insert is then permitted to drain out of the jet nozzle via the gap by gravity.

5 Claims, 10 Drawing Sheets

HYGIENIC WATER JET ASSEMBLY

TECHNICAL FIELD

The present invention generally relates to spas, hot tubs and related devices. In particular, the present invention relates to water jet assemblies for spas, hot tubs and related devices that deliver a combination of water and air therefrom. More particularly, the present invention relates to a water jet assembly for spas, hot tubs and related devices that has a conical cavity to allow residual water within the body of the water jet assembly to freely drain therefrom, to prevent the development of mold and mildew therein.

BACKGROUND

Spas, hot tubs, and the like generally provide a large water containing vessel, such as a tub or pool, that includes a plurality of water jets that combines pressurized streams of water and air into a single stream, so as to deliver a therapeutic effect to the user of the spa. The spa is typically formed of fiberglass, SMC (sheet molding compound) or other moldable material, and is shaped and contoured so that the water jets are positioned to provide the water/air streams in strategic areas while the user is relaxing within the spa. To generate the pressurized stream of water and air, the water jets are fluidly coupled to a water pump system that receives water from a water inlet that is fluidly coupled within the vessel. Also fluidly coupled to the jets is an air pump that is capable of supplying pressurized air to the jet. The water and air are then combined in the jet to create a stream of pressurized water that is entrained with air bubbles, so as to form the therapeutic water/air stream previously discussed. An adjustment knob may also be provided to adjust the flow rate of the water and/or air as desired, such that the water/air steams exiting each water jet may vary between a strong stream or a weak steam.

Typically, to place the spa into operation, the vessel is filled with a quantity of water that is raised to a level that is above the position of the water inlet and above the position of the water jets. As such, during operation of the spa, the water inlet and the water jets remain submerged in the water. This ensures that the pump can continuously draw water from the water inlet for delivery to the water jets, while allowing the water jets to create a therapeutic bubbling/turbulence effect in the water contained in the vessel.

However, due to the nature of spas, it is generally required that they be taken out of operation periodically to conduct routine maintenance or for storage purposes due to a change in seasons. To complete this process, it is generally required that the water remaining in the vessel be removed in order to prevent the growth of mold, mildew, and bacteria in the spa when it is not in use. However, because the water jets are submerged in water during the normal operation of the spa, the water jets continue to retain a residual amount of water within the various internal components of its body after the vessel has been drained of water. That is, current water jet designs do not allow the residual water to drain out from the water jet, thus allowing the residual amount of water to remain within the water jet body. As such, the residual undrained water within the internal surfaces of the water jet serves as the basis for the growth of mold and mildew, as well as other water-borne pathogens, thus leading to a spa that not only has a diminished appearance, but that is also a potential health hazard.

Therefore, there is a need for a hygienic water jet assembly for a spa or other water holding vessel that permits residual water remaining within the water jet assembly to drain out by gravity when the water holding vessel of the spa is drained of water. In addition, there is a need for a hygienic water jet assembly for a spa or other water holding vessel that inhibits the formation of water borne pathogens, as well as mold, mildew, and bacteria on the components of the water jet assembly.

SUMMARY OF THE INVENTION

In light of the foregoing, it is a first aspect of the present invention to provide a hygienic water jet assembly having a body having a jet outlet with a conical surface that is in fluid communication with a water inlet and an air inlet. The water jet includes a control insert with a conical outer surface from which a plurality of spaced protrusions extend. The control insert is rotatably carried by the jet outlet, and the control insert has a cavity that is defined by a conical inner surface. In addition, at least one air control port and at least one water control port are disposed through the control insert. As such, the control insert is rotatably retained within the jet outlet, such that the at least one water control port and the at least one air control port are selectively movable so as to be in fluid communication with the water inlet and the air inlet, respectively. A nozzle is carried in the cavity, such that the nozzle is in fluid communication with the at least one water control port and the at least one air control port to allow the passage of water and air therethrough. In addition, the conical outer surface of the control insert is spaced from the conical surface of the jet outlet by the plurality of protrusions to form a gap therebetween. The gap is in fluid communication with the at least one water control port, the at least one air control port, and the water inlet, such that water within the jet outlet drains by gravity out of the body via the gap.

It is another aspect of the hygienic water jet of the present invention to provide a support housing that is attached to the conical inner surface of the cavity of the control insert to carry the nozzle. In addition, the support housing has a frusto-conical surface that is in fluid communication with the nozzle.

Another aspect of the hygienic water jet of the present invention is that the conical outer surface of the control insert has a first apex that is distal to the nozzle and that the frusto-conical surface of the support housing has a second apex that is proximate to the nozzle.

Yet another aspect of the hygienic water jet of the present invention is that the water inlet includes an elongated tube that extends from the water control inlet at an angle.

Still another aspect of the hygienic water jet of the present invention is that a bezel has an aperture that is disposed therethrough, the bezel being attached to the insert, such that the aperture is substantially aligned with the nozzle, such that the rotation of the bezel rotates the insert.

BRIEF DESCRIPTION OF THE DRAWINGS

This and other features and advantages of the present invention will become better understood with regard to the following description, appended claims, and accompanying drawings wherein:

DETAILED DESCRIPTION

Figure 1:
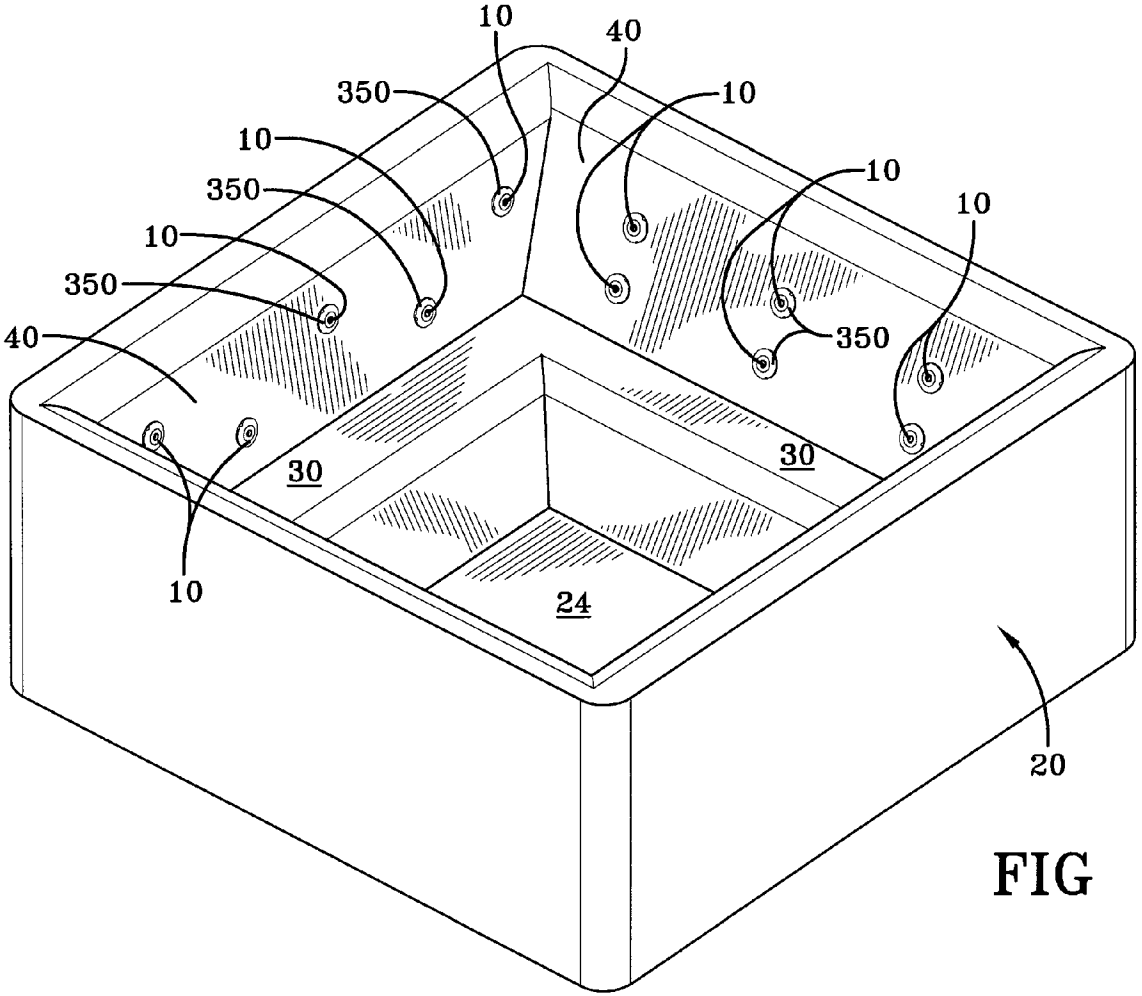
FIG. 1 is a perspective view of a spa including a plurality of hygienic water jet assemblies in accordance with the concepts of the present invention.
Figure 2:
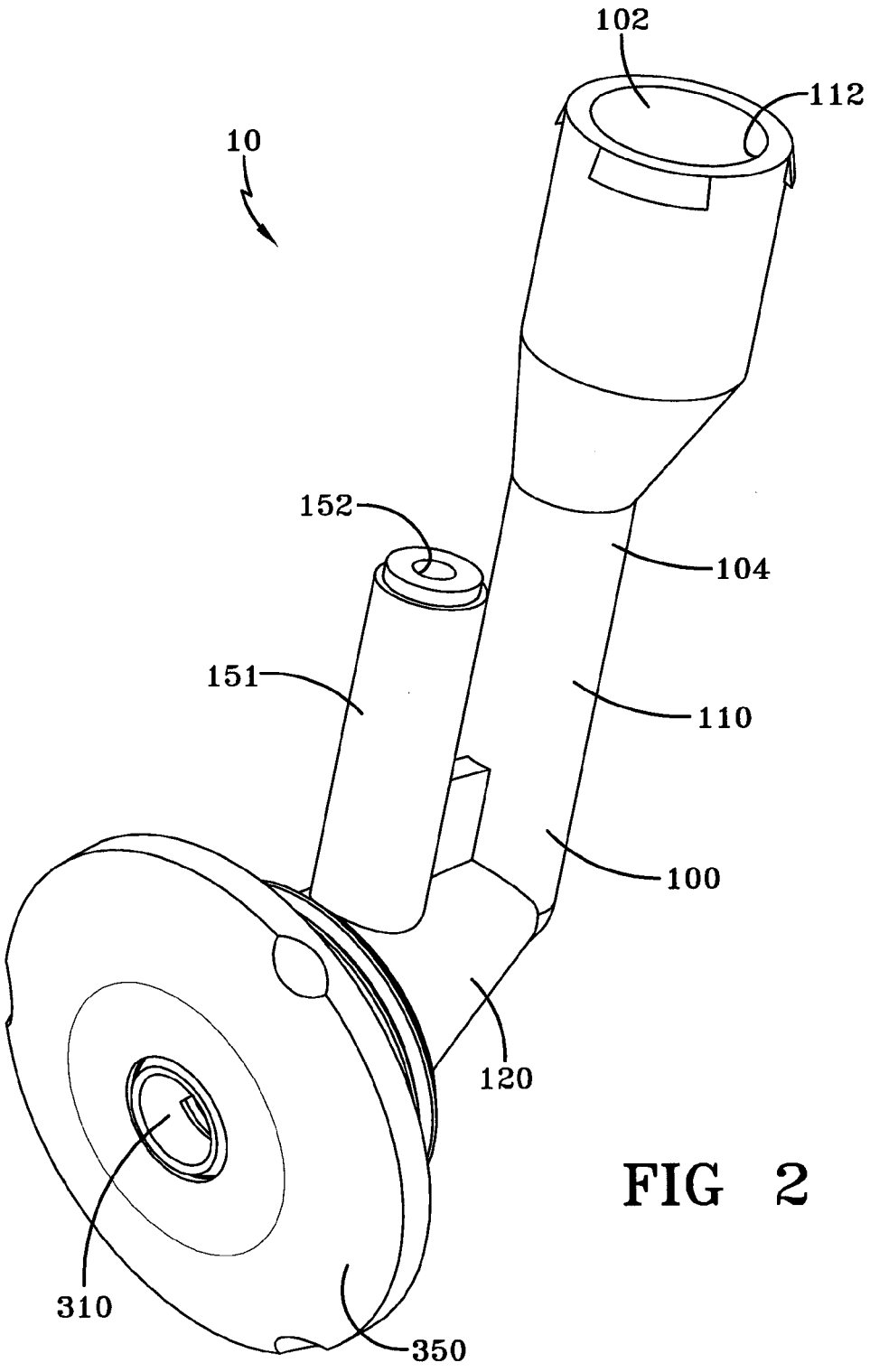
FIG. 2 is a perspective view of the hygienic water jet assembly in accordance with the concepts of the present invention.

A plurality of hygienic water jet assemblies designated by reference numeral 10 are disposed within a spa 20, as shown in FIG. 1 of the drawings. The term 'spa' as used herein is defined as any tub or vessel capable of holding an amount of water or fluid. In particular, the spa 20 includes a water containing vessel 24 that may include one or more seats 30 that are positioned adjacent to a support wall 40 that includes a plurality of water jet assemblies 10. Each of the water jet assemblies 10 are configured to deliver a stream of water that is entrained with air bubbles to the individuals positioned in the spa 20. It should be appreciated that while the discussion of the water jet assembly 10 presented herein relates to the use of the jet assembly 10 with water, it should be appreciated that the jet assembly 10 may be used with any desired fluid.

The water jet assembly 10, shown clearly in FIGS. 2-10, includes a jet body 100 having an inner surface 102 and an outer surface 104 and may be formed of any suitable material, such as plastic or metal for example. Shown clearly in FIGS. 7-9, the body 100 defines an elongated inlet tube 110 terminated at respective inlet and outlet apertures 112 and 114. The inlet tube 110 comprises a substantially cylindrical cross-section, however, any suitable cross-sectional shape may be used. The outlet aperture 114 of the inlet tube 110 opens into a conical jet outlet 120 also provided by the body 100. As such, the body 100 maintains the inlet tube 110 in fluid communication with the conical jet outlet 120. The body 110 may also be configured, such that the inlet tube 110 or a portion thereof extends from the conical jet outlet 120 at an angle to facilitate the flow of water into the conical jet outlet 120.

The inlet aperture 112 of the inlet tube 110 is configured to be coupled to any suitable water source, such as a pressurized water source supplied from a water pump or other fluid pump for example. As such, water delivered to the inlet aperture 112 is permitted to flow through the tube 110 and into the conical jet outlet 120 via the delivery aperture 150.

Figure 7:
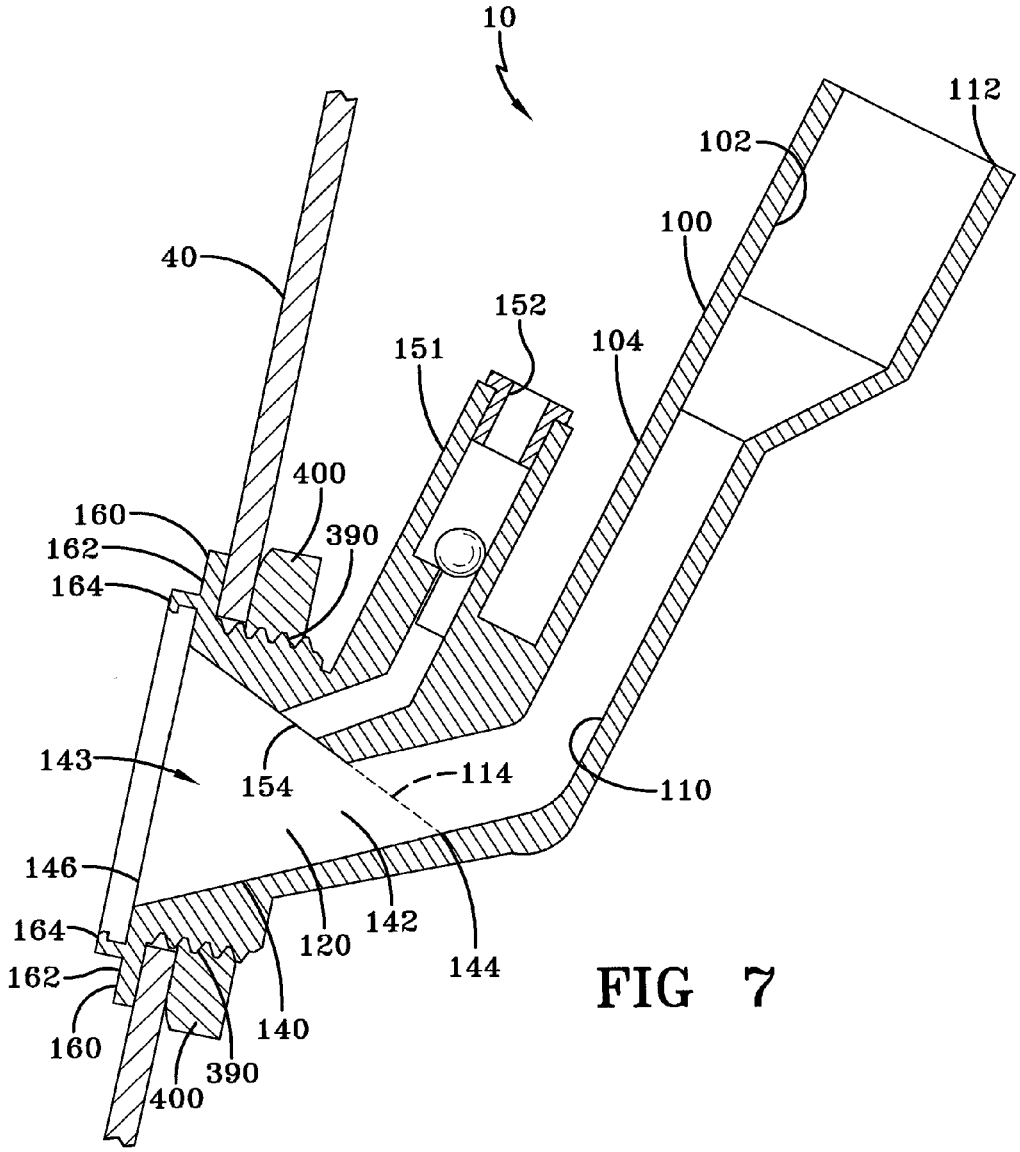
FIG. 7 is a cross-sectional view of the hygienic water jet assembly with the control insert and escutcheon removed in accordance with the concepts of the present invention.
Figure 8:
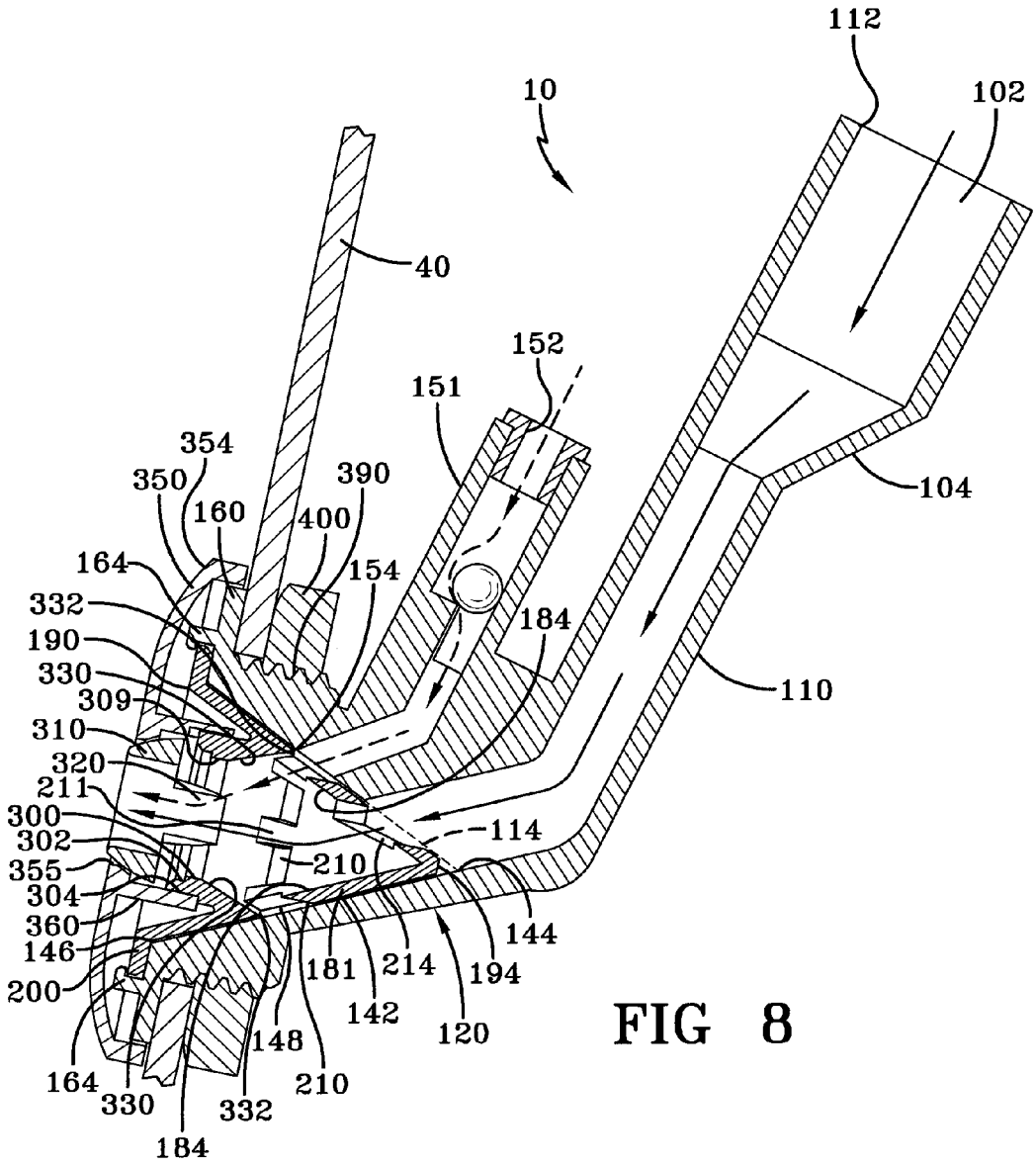
FIG. 8 is a cross-sectional view of the hygienic water jet assembly with the control insert and escutcheon attached, whereby the control insert is rotated to a first position in accordance with the concepts of the present invention.
Figure 9:
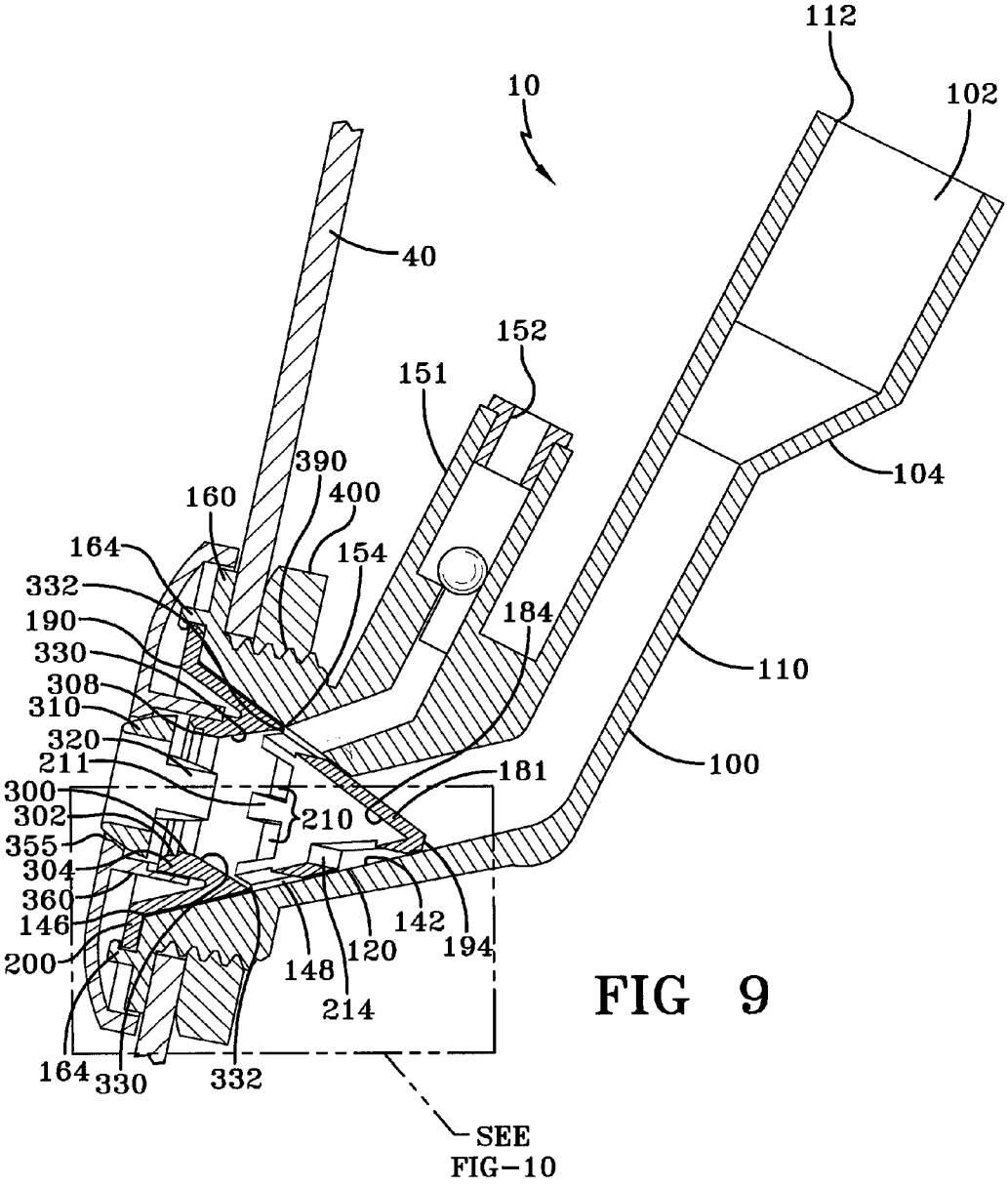
FIG. 9 is an other cross-sectional view of the hygienic water jet assembly with the control insert and escutcheon attached, whereby the control insert is rotated to a second position in accordance with the concepts of the present invention.

Continuing, the conical jet outlet 120 includes a conical wall surface 142 that defines a conical jet cavity 143 that progressively opens from an apex end 144 to an open end 146, as shown clearly in FIG. 7. As such, the open end 146 of the conical jet outlet 120 opens into the jet cavity 143 that is terminated by the apex end 144. It should also be appreciated that the outlet aperture 114 that is disposed in the conical wall surface 142 is positioned proximate to the apex end 144 of the conical jet outlet 120. Extending from the outer surface 102 of the body 100 is an air inlet tube 151 having an air inlet aperture 152 that is in fluid communication with an air receiving aperture 154 that is disposed in the wall surface 142 of the conical jet outlet 120, as shown in FIGS. 7-9. In one aspect, the air receiving aperture 154 is positioned between the water delivery aperture 150 and the open end 146 of the jet outlet 120. It should be appreciated that the air inlet aperture 152 of the air inlet tube 150 is configured to be attached to any suitable pressurized air source, such as that supplied by an air compressor. As such, the fluid inlet tube 110 and the air inlet tube 151 are in fluid communication with the conical jet outlet 120. Furthermore, positioned about the periphery of the open end 124 of the conical jet outlet 120 is an annular flange 160 that includes a face surface 162 having one or more retainer clips 164 disposed thereon.

Figure 3:
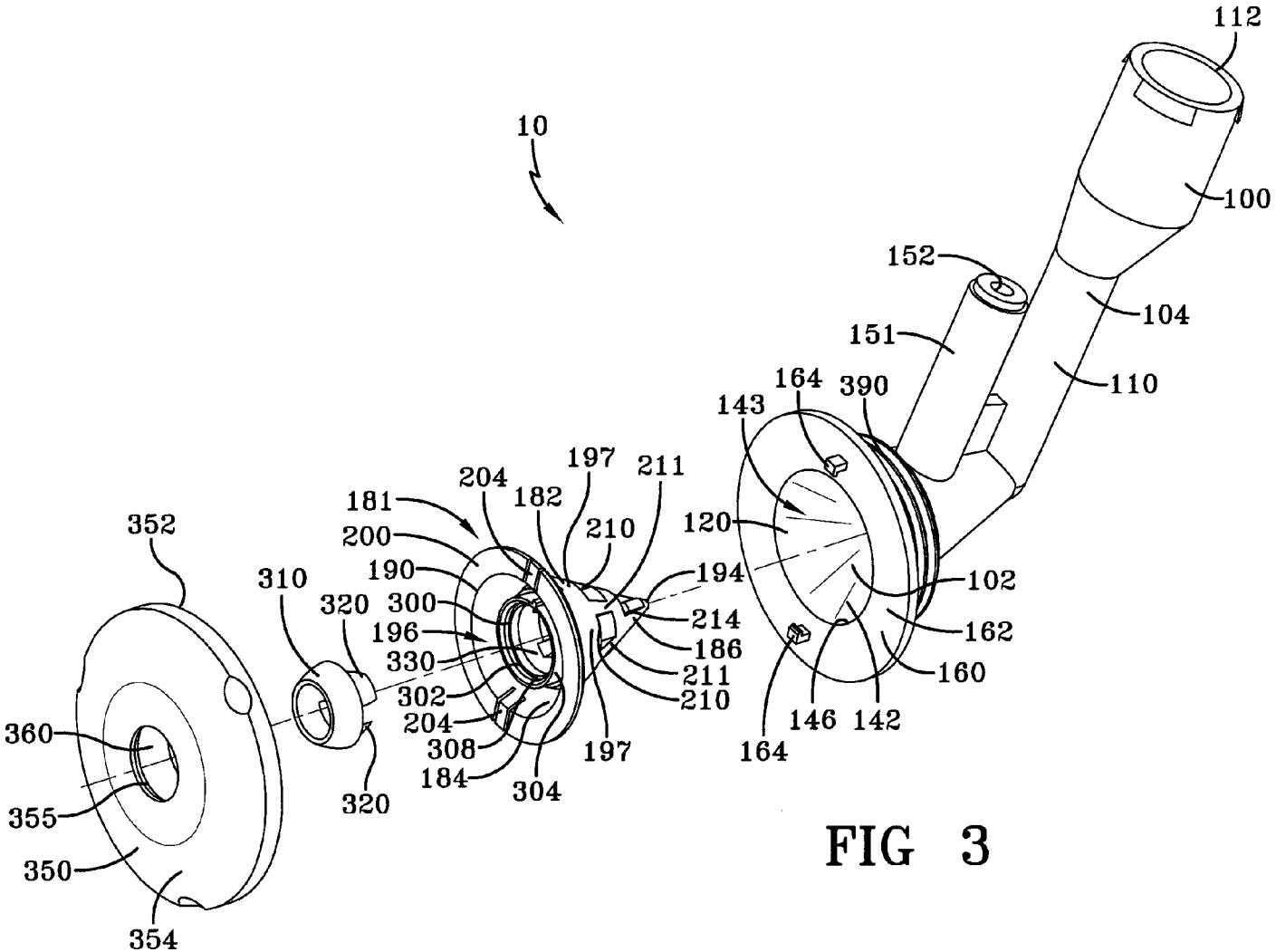
FIG. 3 is an exploded view showing the components of the hygienic water jet assembly in accordance with the concepts of the present invention.
Figure 4:
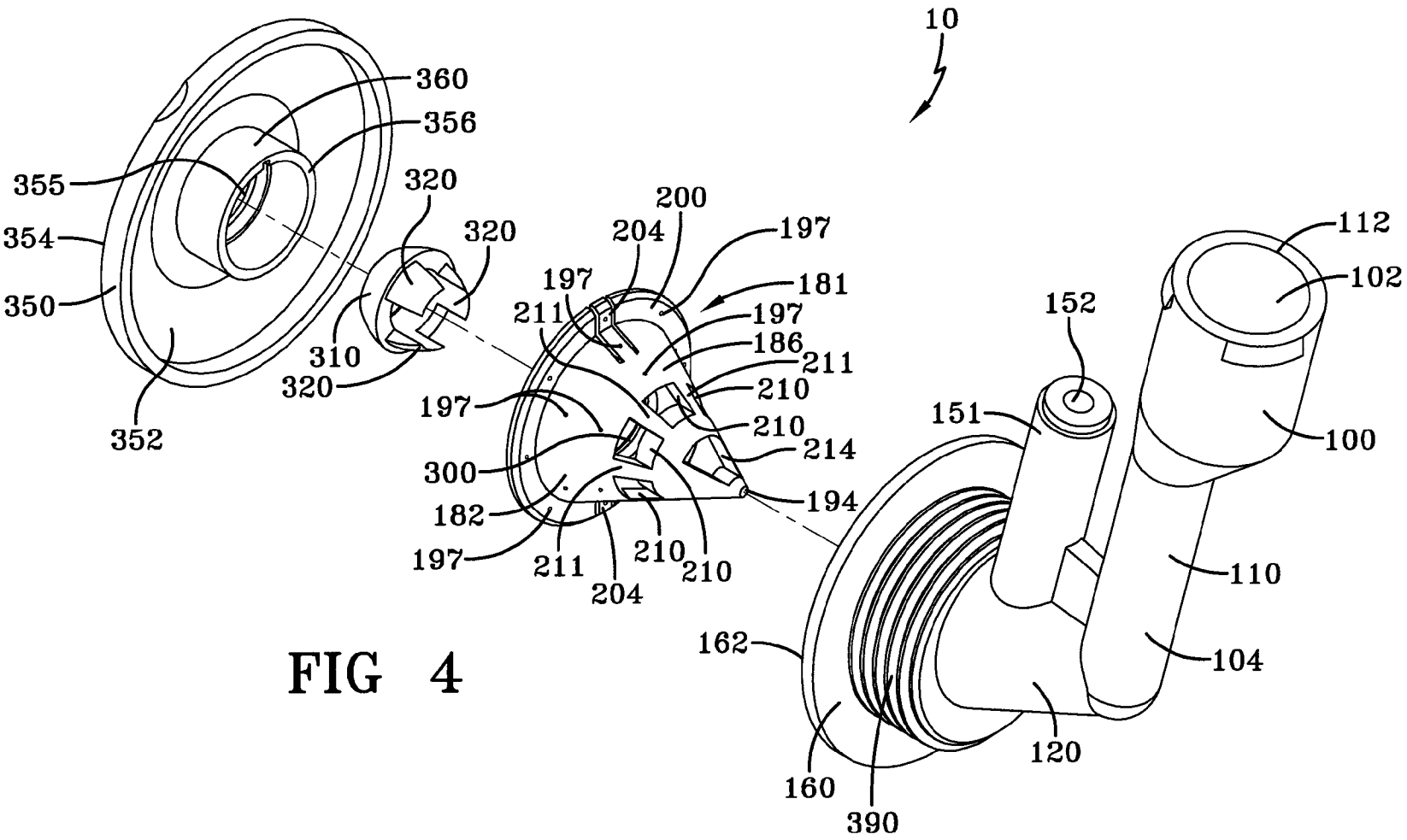
FIG. 4 is another exploded view showing the components of the hygienic water jet assembly in accordance with the concepts of the present invention.
Figure 5:
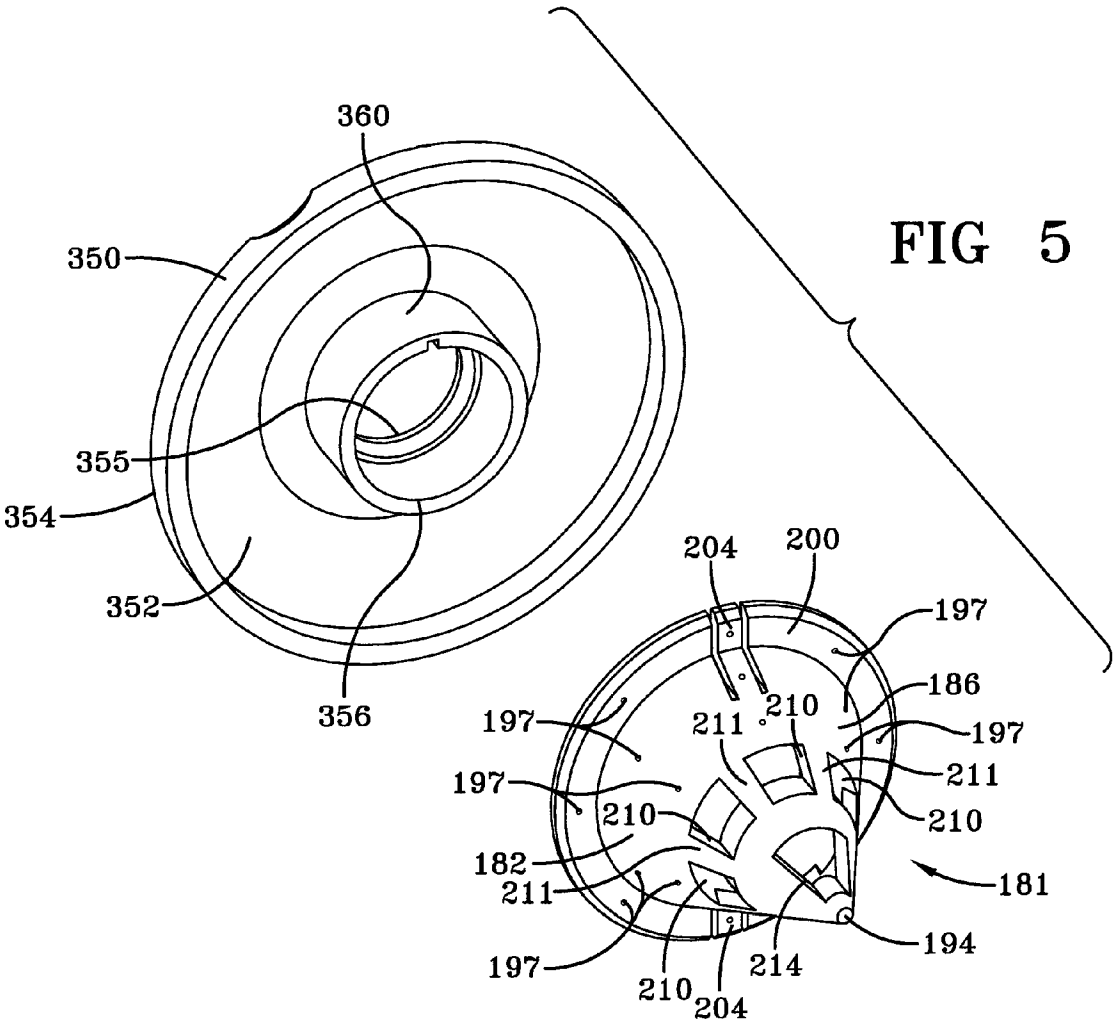
FIG. 5 is a perspective view of an escutcheon and a control insert provided by the hygienic water jet assembly in accordance with the concepts of the present invention.

The jet assembly 10 also includes a conical control insert 181 that is configured to be received within the jet cavity 143, as shown in FIGS. 3-10. The control insert 181 includes a conical body 182 having an inner and outer surface 184 and 186, as shown in FIGS. 3-6. The conical body 182 extends from an open end 190 to an apex end 194, such that the open end 190 opens into an insert cavity 196. Disposed about the periphery of the open end 190 is a control flange 200 having a plurality of tabs 204 disposed thereon. In one aspect, the tabs 204 may be diametrically arranged on the flange 200. At least partially circumscribing the conical body 182 of the control insert 181 are one or more spaced air control ports 210 that are positioned proximate to the opened end 190, as shown in FIGS. 3-5. In addition, a water control port 214 that is positioned proximate to the apex end 194 of the control insert 181 partially circumscribes the conical body 182 of the control insert 181, also shown clearly in FIGS. 3-5. Specifically, the air ports 210 are separated by stop sections 211. Thus, when the control insert 181 is inserted within the jet cavity 143 of the conical jet outlet 120, the air ports 210 are positioned to be in selective fluid alignment with the air delivery aperture 154 of the air inlet tube 151, while the water port 214 is configured to be positioned in selective fluid alignment with the outlet aperture 114 of the water inlet tube 110. In order to rotatably retain the conical insert 181 within the jet cavity 143, the control flange 200 of the conical insert 181 is rotatably retained by the retainer clips 164 of the conical jet outlet 120. As such, the control insert 181 is configured to rotate within the jet cavity 143 of the conical jet outlet 120, such that the air ports 210 and the water port 214 of the control insert 181 are selectively aligned with the air receiving aperture 154 and the water outlet aperture 114, as shown in FIGS. 8 and 9. That is, because the air ports 210 and the water port 214 do not fully circumscribe the control insert 181, the control insert 181 may be rotated so that the air delivery aperture 154 and the water outlet aperture 114 are selectively blocked by the outer surface 186 of the control insert 181. For example, FIG. 8 shows the control insert 181 rotated so that both the air receiving aperture 154 and the water inlet aperture 114 are opened, while FIG. 9 shows the air receiving apertures 154 opened and the water inlet aperture 114 closed. As such, the amount of air permitted to be combined with the incoming water within the jet 10 can be controlled, while the amount of water permitted to be combined with incoming air within the jet 10 can be controlled. In one aspect, the water supplied to the jet 10 by the inlet tube 110 may be completely turned off by rotating the control insert 181 to block the water outlet aperture 114.

Figure 10:
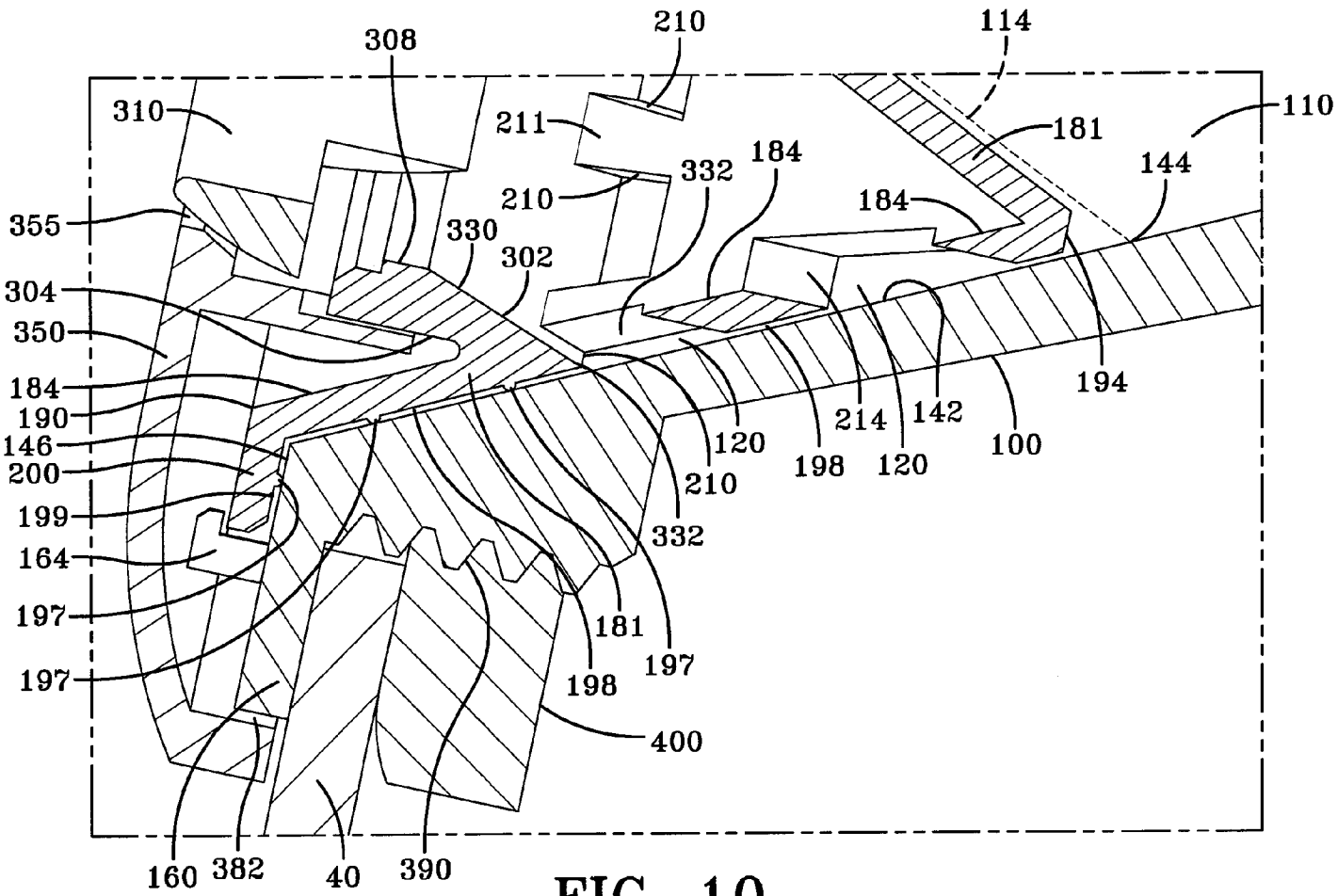
FIG. 10 is a cross-sectional view showing a gap formed between the water jet body and control insert of the hygienic water jet assembly in accordance with the concepts of the present invention.

Furthermore, the jet cavity 143 is dimensioned such that when the control insert 181 is seated therein, the outer surface 186 of the control insert 181 is spaced from the conical wall surface 142, thereby defining a gap 198 therebetween, as shown in FIG. 10. In addition, the control insert 181 forms a gap 199 between the control flange 200 of the conical insert 181 and the face surface 162 of the flange 160 of the body 100. Such a configuration facilitates the flow of water out of the jet 10. It should be appreciated that such gaps 198 and 199 may be formed by the use of a plurality of spaced apart protrusions 197 that extend away from the outer surface 186 of the body 182 and the control flange 200 of the control insert 181. That is, the protrusions 197 serve to space the control insert 181 from the conical wall surface 142 of the jet outlet 120, so as to define the gaps 198 and 199 therebetween, which allows for the flow of water within the jet 10 to be routed out. In one aspect, the protrusions 197 may be arranged in any suitable configuration, such as a random configuration or a predetermined configuration, such that specific water carrying channels are formed.

Attached to the inner surface 184 of the cavity 196 of the conical control insert 181 is an annular support housing 300 having an inner wall 302 and an outer wall 304, such that the inner wall 302 defines an annular support aperture 308 that is dimensioned to retain a nozzle 310 therein. The support housing 300 also includes a frusto-conical or truncated conical surface 330 that extends from the annular support aperture 308. It should be appreciated that the tapered or frusto-conical surface 330 is configured so that its apex (not shown) is proximate to the open end 190 of the control insert 181 and has an opening 332 that is proximate to the apex 194 of the conical insert 181. As such, the control insert 181 includes two conical surfaces; the inner conical surface 184 provided by the body 182 of the control insert 181 and the frusto-conical surface 330 of the support housing 300 also provided by the control insert 181. As such, the conical surfaces 184 and 330 effectively open into each other.

Continuing, the nozzle 310 may include tabs 320 that are configured to engage the support aperture 300, such as in a "snap-fit" or "friction-fit" manner, to retain the nozzle 310 therein, however it should be appreciated that any suitable means of fixation may be used to retain the nozzle 310 within the support aperture 300. In one aspect, the nozzle 310 may be pivotably retained within the support aperture so that it can be moved or articulated into any desired position, so that the water/air stream generated at the water jet outlet 120 can be routed in any desired direction.

Figure 6:
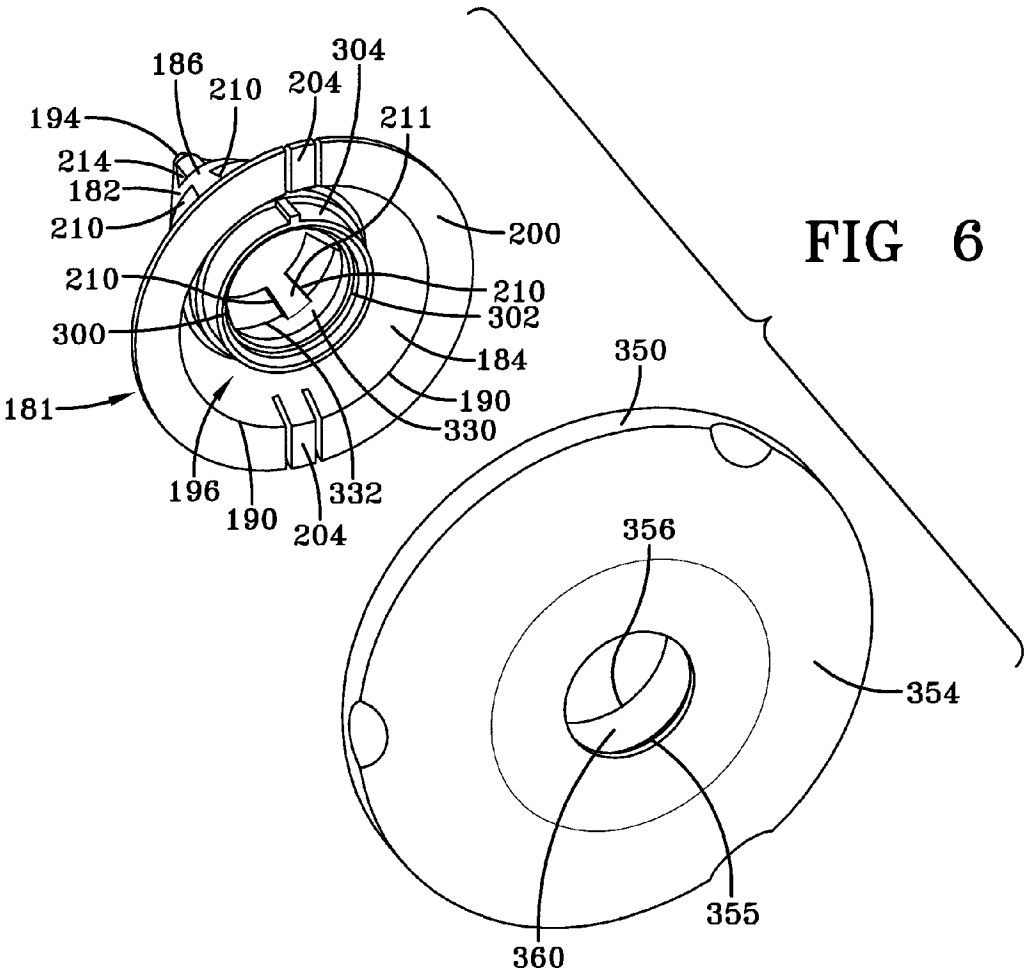
FIG. 6 is another perspective view of the escutcheon and the control insert of the hygienic water jet assembly in accordance with the concepts of the present invention.

Attached to the conical control insert 181 is an annular escutcheon or bezel 350 having an inner surface 352 and outer surface 354, as shown clearly in FIGS. 5 and 6. Disposed through the bezel 350 is a centrally disposed bezel aperture 355. Extending from the inner surface 352 of the bezel 350 is an annular wall 360 that circumscribes the periphery of the aperture 354, and which defines a wall aperture 356. As such, the wall aperture 356 is configured to receive the outer wall 304 of the annular support housing 300 of the control insert 181 therein so as to be interference fit therewith, thereby joining the bezel 350 with the control insert 181. However, it should be appreciated that the bezel 350 may be attached to the control insert 181 using any suitable means of fixation, such as adhesive for example. It should also be appreciated that the bezel aperture 354 of the bezel 350 is dimensioned to allow at least a portion of the nozzle 300 to extend therethrough. Thus, rotation of the bezel 350 causes the conical insert 181 to also be rotated as well, so as to control or adjust the position of the air ports 210 and the water port 214 within the conical jet outlet 120 to control amount of water and air that is permitted pass from the air and water delivered thereby, as previously discussed. In addition, the inner surface 352 of the bezel 350 is spaced from an outer edge 380 of the body flange 160 to define a gap 382, which is dimensioned to allow water exiting through gap 199 to drain therethrough. It should be appreciated, that in one aspect, the inner surface 352 of the bezel 350 may be angled to facilitate the flow of water out of the jet 10. It should also be appreciated that because the retainer clips 164 do not fully circumscribe the face 162 of the flange 160 they do not impede the drainage of water out of the jet 10.

Circumscribing the outer surface 104 of the body 100 proximate to the conical jet outlet 120 is a plurality of threads 390, which allows a threaded nut 400 to be threadably received, so as to retain a portion of the wall 40 of the spa 20 between the body flange 160 and the nut 400. However, it should be appreciated that any suitable means of fixation may be used to attach the jet 10 to the spa 20.

As such, the gaps 198, 199, and 382 together with the conical surfaces 330,184 of the control insert 181 and the conical surface 142 of the jet outlet 120 allows any residual water within the water jet 10 to be drained, by operation of gravity, out of the water jet 10.

Therefore, one advantage of the present invention is that a hygienic water jet assembly for a spa has conical internal surfaces that routes unwanted water within the water jet to drain out, thereby preventing the growth of mold, mildew and bacteria therein. Still another advantage of the present invention is that a hygienic water jet assembly for a spa has internal gaps, which facilitate the drainage of residual water out of the jet. Yet another advantage of the present invention is that the hygienic water jet assembly for a spa is able to be readily retrofit to existing spas.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A hygienic water jet assembly comprising:

a body having a jet outlet with a conical surface that is in fluid communication with a water inlet and an air inlet;

a control insert having a conical outer surface from which a plurality of spaced protrusions extend, said control insert rotatably carried by said jet outlet, said control insert having a cavity defined by a conical inner surface, at least one air control port and at least one water control port disposed through said control insert, said control insert rotatably retained within said jet outlet, such that said at least one water control port and said at least one air control port are selectively movable so as to be in fluid communication with said water inlet and said air inlet, respectively; and a nozzle carried in said cavity, said nozzle in fluid communication with said at least one water control port and said at least one air control port to allow the passage of water and air therethrough, wherein said conical outer surface of said control insert is spaced from said conical surface of said jet outlet by said plurality of protrusions to form a gap therebetween, said gap in fluid communication with said at least one water control port, said at least one air control port, and said water inlet, such that water within said jet outlet drains by gravity out of said body via said gap.

2. The hygienic water jet of claim 1, further comprising a support housing attached to said conical inner surface of said cavity of said control insert to carry said nozzle, said support housing having a frusto-conical surface in fluid communication with said nozzle.

3. The hygienic water jet of claim 2, wherein said conical outer surface of said control insert has a first apex distal to said nozzle and said frusto-conical surface of said support housing has a second apex that is proximate to said nozzle.

4. The hygienic water jet of claim 1, wherein said water inlet comprises an elongated tube that extends from said water control inlet at an angle.

5. The hygienic water jet assembly of claim 1, further comprising a bezel having an aperture disposed therethrough, said bezel attached to said insert, such that said aperture is substantially aligned with said nozzle, whereupon the rotation of said bezel rotates said insert.

* * * * *